US006511125B1

(12) United States Patent
Gendron

(10) Patent No.: US 6,511,125 B1
(45) Date of Patent: Jan. 28, 2003

(54) VENTILATED SEAT PAD

(76) Inventor: Timothy D. Gendron, 13351 Crampton Rd., Camden, MI (US) 49232

( * ) Notice: Subject to any disclaimer, the term of this patent is extended or adjusted under 35 U.S.C. 154(b) by 0 days.

(21) Appl. No.: 09/668,165

(22) Filed: Sep. 25, 2000

(51) Int. Cl.[7] ..... A47C 7/72

(52) U.S. Cl. ..... 297/180.11; 297/180.13; 297/180.14; 297/452.47; 297/452.43

(58) Field of Search ..... 297/180.11, 180.13, 297/180.14, 452.47, 452.43; 5/421, 724, 652.1

(56) References Cited

U.S. PATENT DOCUMENTS

| | | | | | |
|---|---|---|---|---|---|
| 376,094 | A | * | 1/1888 | Hurlburt | 5/641 |
| 2,992,604 | A | * | 7/1961 | Trotman et al. | 454/120 |
| 3,162,489 | A | * | 12/1964 | Trotman | 297/452.45 |
| 4,006,604 | A | * | 2/1977 | Seff | 62/261 |
| 4,563,387 | A | * | 1/1986 | Takagi et al. | 442/334 |
| 4,712,832 | A | * | 12/1987 | Antolini et al. | 297/180.11 |
| 4,853,992 | A | * | 8/1989 | Yu | 5/423 |
| 5,002,336 | A | * | 3/1991 | Feher | 297/180.13 |
| 5,597,200 | A | * | 1/1997 | Gregory et al. | 297/180.13 |
| 5,787,525 | A | * | 8/1998 | Sugihara | 5/421 |
| 5,870,785 | A | * | 2/1999 | Hoorens | 5/652.1 |
| 5,887,304 | A | * | 3/1999 | von der Heyde | 5/726 |
| 5,902,014 | A | * | 5/1999 | Dinkel et al. | 297/452.43 |
| 5,921,858 | A | * | 7/1999 | Kawai et al. | 454/120 |
| 5,926,884 | A | * | 7/1999 | Biggie et al. | 5/714 |
| 6,068,332 | A | * | 5/2000 | Faust et al. | 297/180.13 |
| 6,179,706 | B1 | * | 1/2001 | Yoshinori et al. | 454/120 |

* cited by examiner

*Primary Examiner*—Peter M. Cuomo
*Assistant Examiner*—Joseph Edell
(74) *Attorney, Agent, or Firm*—Charles W. Chandler

(57) ABSTRACT

A ventilated seat pad for supporting an occupant includes first, second, third, fourth, and fifth layers formed into a back portion and a seat portion. Perforations are formed in the first layer to direct ventilating air to an occupant. The second layer provides cushioning and ventilation for the occupant. A hole pattern is formed in the third layer. The hole pattern includes holes in the back portion and the seat portion. An air chamber is formed in the fourth layer in communication with the hole pattern of the third layer. A nozzle and hose direct ventilating air to the air chamber attached to the fifth layer. Ventilating air is directed to holes in the back portion of the third layer when an occupant sitting on the seat portion restricts holes in the seat portion of the third layer. The occupant receives ventilated air in the seat and back area simultaneously.

2 Claims, 3 Drawing Sheets

VENTILATED SEAT PAD

BACKGROUND OF THE INVENTION

This invention relates in general to a ventilated seat pad or topper. More specifically, this invention relates to a ventilated seat pad constructed to be connected to a forced air system of a vehicle.

Seat pads are well known. Many seat pads provide cushioning for an occupant and protection for a seat. Some seat pads for vehicles are designed to be connected by a conduit to a vehicular ventilation system. Forced air, including cooled and heated air can be directed through the seat pad to provide comfort to the occupant.

SUMMARY OF THE INVENTION

It is desirable to provide a ventilated seat pad that is economical to manufacture and simple to install. Furthermore, it is desirable to provide a ventilated seat pad that directs ventilation to both the seat and back areas of the pad.

This invention includes a ventilated seat pad that is easily and quickly connected to a ventilation system of a vehicle. The ventilated seat pad includes an economical system for directing ventilation to both the seat and back portions of the pad when an occupant is seated on the seat pad. The ventilated seat pad can be fitted on a variety of vehicular seats and easily attached by straps and fasteners, and is washable and comfortable.

In a preferred embodiment, a ventilated seat pad for supporting an occupant includes five layers formed into a back portion and a seat portion. Perforations are formed in the first layer to direct ventilating air to an occupant. The second layer provides cushioning and ventilation control for the occupant. A hole pattern is formed in the third layer. The hole pattern includes holes in the back portion and the seat portion. An air chamber is formed in the fourth layer in communication with the hole pattern of the third layer. A nozzle and hose direct ventilating air to the air chamber are attached to the fifth layer. Ventilating air is directed to holes in the back portion of the third layer when an occupant sitting on the seat portion restricts holes in the seat portion of the third layer.

Various objects and advantages of this invention will become apparent to those skilled in the art from the following detailed description of the preferred embodiments, when read in light of the accompanying drawings.

DETAILED DESCRIPTION OF THE PREFERRED EMBODIMENT

Figure 1:
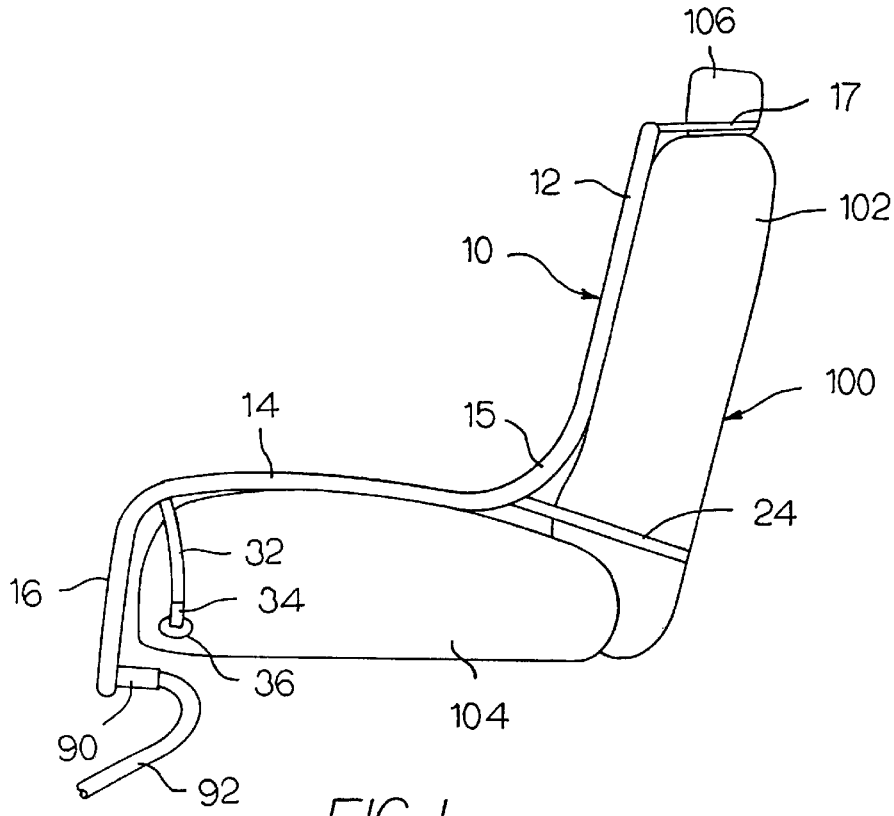
FIG. 1 is a side view of a ventilated seat pad according to this invention mounted on a vehicular seat.
Figure 2:
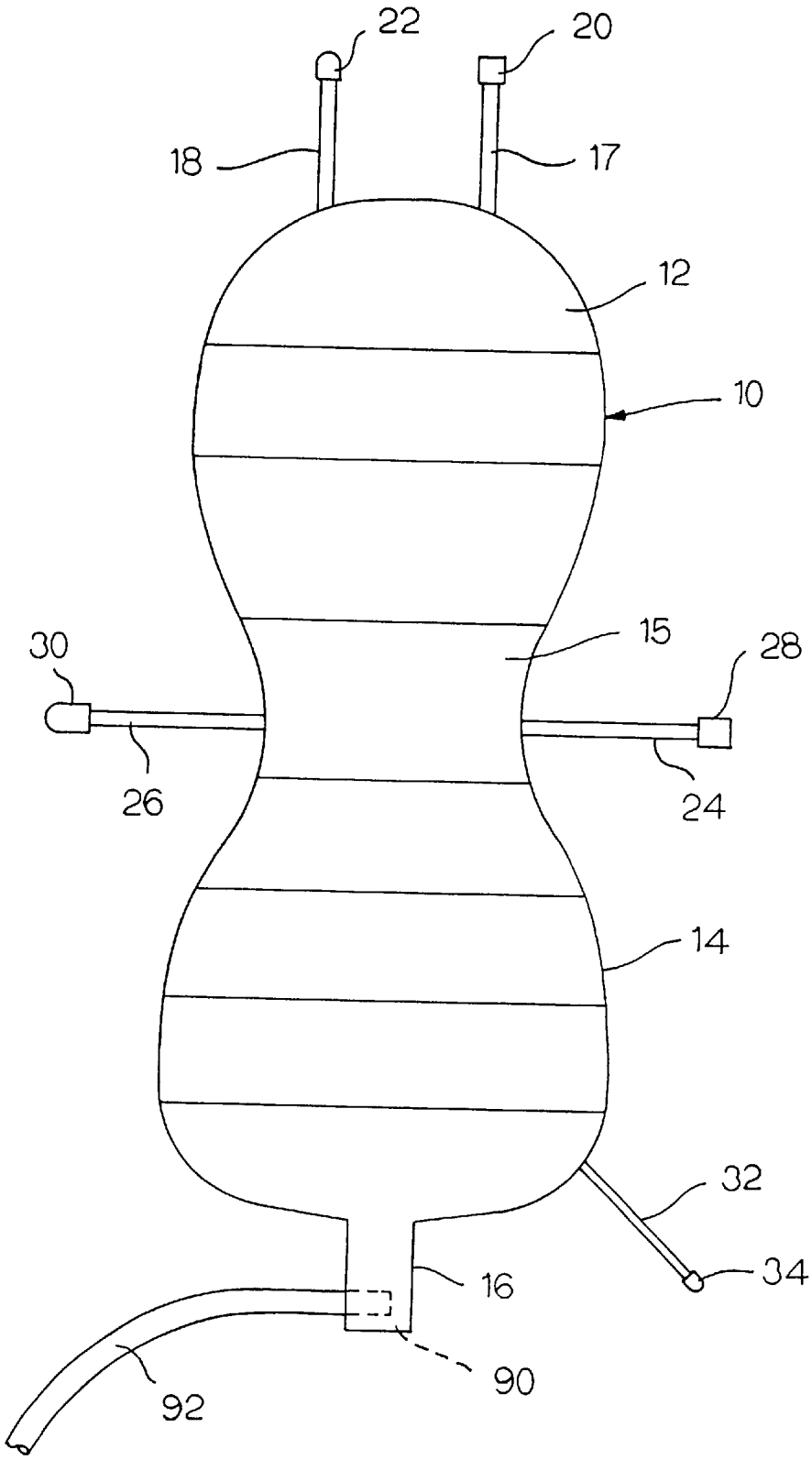
FIG. 2 is an enlarged front view of the ventilated seat pad of FIG. 1 removed from the vehicular seat.

A preferred embodiment of a ventilated seat pad or topper according to this invention is indicated generally at 10 in FIGS. 1 and 2. Pad 10 is particularly constructed to be secured to a vehicular seat 100 and provide comfort to an occupant. Pad 10 is shown as an add-on accessory for a conventional vehicular seat, however, it could also be integrated as part of a complete seat sold to an original equipment manufacturer. Preferable, pad 10 is sized to cover substantial portions of a seat back 102 and a seat bottom 104 of vehicular seat 100.

Pad 10 includes a back portion 12 and a bottom portion 14. A middle portion 15, contoured for comfort, is provided between back portion 12 and bottom portion 14. An extension 16 extends from the forward edge of bottom portion 14. Preferably, back portion 12, bottom portion 14, middle portion 15, and extension 16 are formed as an integral member.

When installed on vehicular seat 100, back portion 12 covers a substantial part of an outer surface of seat back 102. A pair of straps 17 and 18 are attached to back portion 12 and wrapped about a headrest 106 or seat back of vehicular seat 100. Fasteners 20 and 22 of any desired type, including a connector and buckle, can be used to connect straps 17 and 18.

A pair of straps 24 and 26 are attached to middle portion 15 and wrapped about a lower portion of seat back 102. Fasteners 28 and 30 of any desired type are used to connect straps 24 and 26.

A strap 32 is attached to bottom portion 14 and wrapped about seat bottom 104. A fastener 34 of any desired type, including a strip of hook-and-loop fasteners (e.g. Velcro) can be used to attach an elastic strap 32 to a receiving patch 36 on seat bottom 104.

Figure 3:
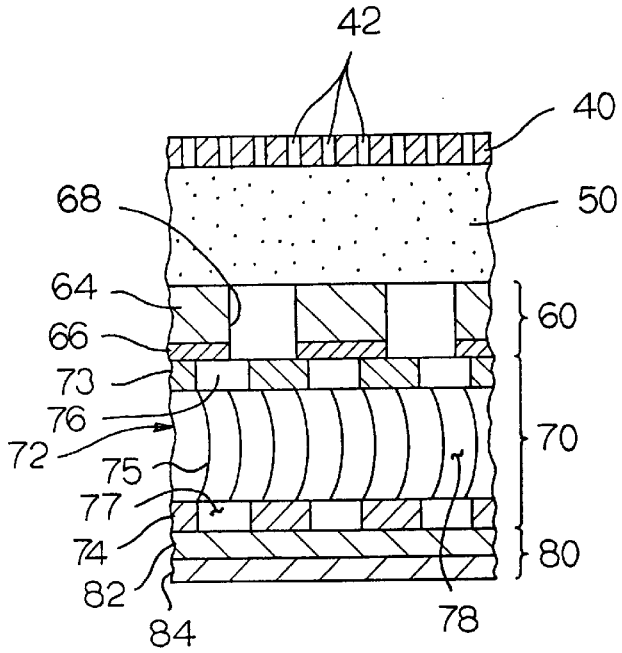
FIG. 3 is an enlarged sectional view of the ventilated seat pad of FIGS. 1 and 2, illustrating five layers.
Figure 4:
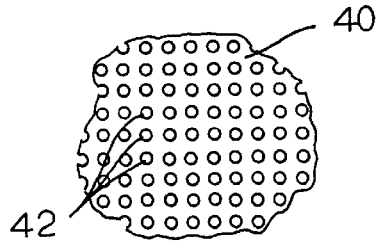
FIG. 4 is a top view of a portion of the first layer of FIG. 3 illustrating a plurality of ventilation openings.

Pad 10 is formed as a plurality of layers. Air travels between the layers to provide comfort to an occupant. As illustrated in FIGS. 3 and 4, a first layer 40 is formed from an air permeable material such as fabric having relatively small openings or perforations 42. First layer 40 is a top or outer layer upon which an occupant sits. As described below, air escaping from openings 42 provides comfort to an occupant.

A second layer 50 is formed from an air permeable cushioning material such as a polymeric fiber. Preferably, a relatively thick layer 50 of the fiber is used to provide cushioning for an occupant.

Figure 5:
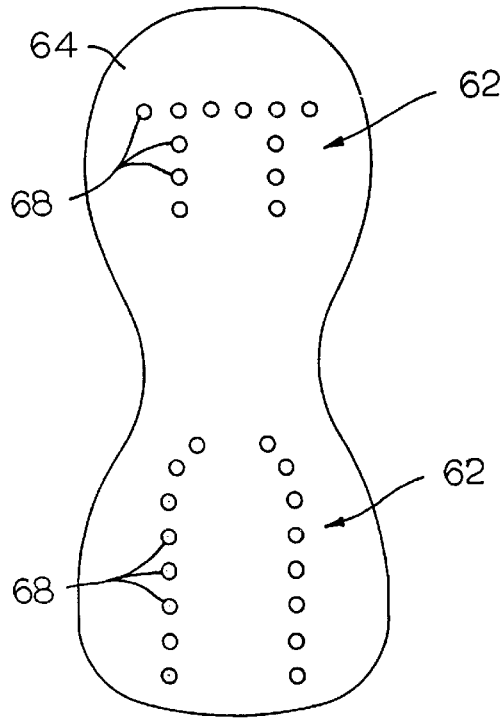
FIG. 5 is a reduced top view of the third layer of FIG. 3 illustrating a pattern of air holes arranged to provide ventilation to an occupant.

As illustrated in FIGS. 3 and 5, a third layer 60 is formed from a material that has a selected hole pattern 62. A preferred material for third layer 60 is a foam layer 64 having an air impermeable backing 66. Hole pattern 62 includes relatively large, aligned holes 68 passing through foam 64 and backing 66. Preferably, hole pattern 62 directs air to the upper surface of back portion 12 and seat portion 14, as described below.

Figure 6:
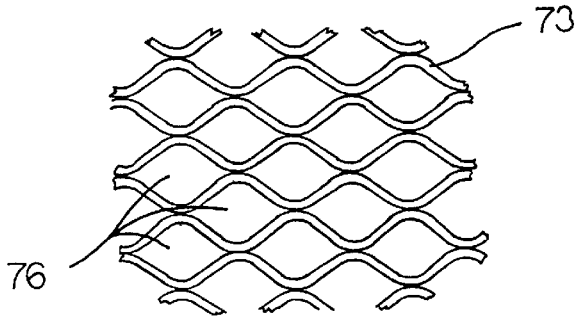
FIG. 6 is a top view of a portion of the fourth layer of FIG. 3 illustrating a honeycomb patter.

A fourth layer 70 is formed from an air permeable spacer material 72. Spacer material 72 is relatively stiff and supports the weight of an occupant without completely collapsing. Spacer material 72 is formed as a top layer 73 and a bottom layer 74 separated by spacing webs 75. As illustrated best in FIG. 6, top layer 73 is formed as a honeycomb pattern having relatively large openings 76. In a similar manner, bottom layer 74 is formed as a honeycomb pattern having relatively large openings 77. Spacing webs 75 are woven into top layer 73 and bottom layer 74. Spacing webs 75 provide resistance to the weight of an occupant so that an air chamber 78 is present in the fourth layer even when an occupant is sitting on pad 10.

A fifth layer 80 is formed from an air impermeable material. Preferably, fifth layer 80 includes a layer of vinyl 82 that prevents the escape of air. An outer surface of the vinyl is covered with a felt backing 84.

As illustrated in FIGS. 1 and 2, extension 16 of the pad 10 includes a fitting 90. A hose 92 has a first end attached to fitting 90. A second end of the hose 92 is connected to a forced air unit of a vehicle in any desired manner. For example, the second end of hose 92 can be attached to a vent opening under the vehicle dash. Cooled and heated air from the forced air unit of the vehicle is directed to pad 10 through hose 92. Air enters air chamber 78 formed by spacer fabric 72 of the fourth layer 70. Air from air chamber 78 passes through holes 68 of hole pattern 62 of the third layer 60. Air then passes through the second layer 50 and escapes from pad 10 through openings 42 of first layer 40 to provide comfort to the occupant.

The second layer has several functions: comfort is one but the most important is to prevent the top layer from closing off the large holes in the third layer when the occupant is seated. The fiber density is critical in that it must allow airflow under compression, but not be so porous that air can flow unrestricted horizontally. When seated, the occupant receives air in the bottom portion 14 and in the back portion 12.

The second layer also acts as a manifold to distribute the air coming through holes 68 to the top layer holes of 42. Without the second layer, the occupant would feel local cooling or heating only directly above the holes in the third layer, and predominately only in the back. The spacing of the holes in the third layer with respect to the occupant and the air flow management of the fibrous second layer combine to cool or heat the occupant uniformly throughout the contact area.

When an occupant sits on pad 10, spacer material 72 of the fourth layer 70 is strong enough to prevent third layer 60 from contacting the fifth layer 80, thus maintaining air chamber 78. The second layer of fiber prevents the air from escaping through the pad where it would not benefit the occupant.

The weight of an occupant on seat portion 14 causes first layer 40 and second layer 50 to restrict air flow from hole pattern 62 in the seat portion 12 of third layer 50. Thus, air in the air chamber 78 is directed to back portion 12 so that ventilation is also provided to the upper torso of the occupant.

Various materials can be used for layers 40, 50, 60, 70, and 80. The fifth layer 80 is formed from an air impermeable material. Perforations are provided in first layer 40 so that air escapes from the pad to provide ventilation to the occupant. The spacer fabric 72 of third layer 70 supports the weight of the occupant and maintains an air chamber 78.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

Having described my invention, I claim:

1. A ventilated seat pad apparatus for supporting an occupant thereon, the seat pad apparatus comprising a plurality of stacked fabric layers including:

a flexible first layer having a plurality of openings to pass ventilating air therethrough;

a second layer formed of an air permeable cushioning material;

a flexible third foam layer having a selected hole pattern for directing air toward the second layer for distribution toward the first layer, the third foam layer having an air impermeable backing with a selected hole pattern aligned with the selected hole pattern in the flexible third foam layer;

a fourth layer having a top layer, spacing webs, and a bottom layer of an air permeable spacer material forming an air chamber therebetween, the fourth layer including a spacer fabric that supports an occupant, the spacer fabric including stiff non-metal spacing webs secured between the top and bottom layers so as to be deformable by the weight of the user whereby the fourth layer maintains an air chamber beneath the third layer, the top and bottom layers of the spacer fabric being formed of a honeycomb pattern to pass air toward the hole pattern of the third layer;

a fifth layer formed of an air impermeable material that prevents the escape of air, the fifth layer further having a felt backing on the outer surface of the air impermeable material;

the cushioning material of the second layer partially restricting the passage of air through the hole pattern of the third layer depending upon the weight and location of a user sitting on the seat pad; and means for directing ventilating air to the air chamber and then through the selected hole pattern of the third layer and through the openings in the first layer to provide comfort to the occupant.

2. A ventilated seat pad apparatus for supporting a user, the seat pad apparatus having a seat pad portion, and back pad portion in fluid communication with the seat pad portion, the seat pad apparatus comprising:

first, second, third, fourth and fifth stacked planar layers formed into a back portion and a seat portion;

the first layer being flexible and having a plurality of perforations to direct ventilating air to an occupying user;

the second layer providing air permeable cushioning material adjacent the first layer;

the third layer being flexible and made of a foam having a selected first hole pattern for directing air toward the second layer for distribution toward the first layer, the foam third layer having an air impermeable backing with a selected hole pattern aligned with the selected hole pattern in the flexible foam third layer;

the fourth layer having a top layer portion, spacing webs, and a bottom layer portion of an air permeable material forming an air chamber therebetween, the fourth layer being formed of a spacer fabric that supports the user, the spacer fabric including spacing webs secured to the top layer portion and the bottom layer portion, so as to be deformable while providing an air chamber beneath the third layer, the fourth layer having a second hole pattern providing fluid communication with the air chamber and the first hole pattern of the third layer, the spacer fabric having at least a top layer being formed of a honeycomb pattern to pass air toward the hole pattern of the third layer, the honeycomb hole pattern partially restricting the passage of air depending upon the weight and location of a user sitting on the seat pad portion; and directing means attached to the fifth layer for directing ventilating air to the air chamber;

wherein ventilating air is directing from the air chamber toward the first hole pattern of the third layer of the back pad portion when holes in the first hole pattern of the third layer of the seat pad portion are restricted by a user sitting on the seat pad portion.

* * * * *